United States Patent [19]

Stewart et al.

[11] Patent Number: 4,588,190

[45] Date of Patent: May 13, 1986

[54] BALL REBOUND APPARATUS

[75] Inventors: James R. Stewart, San Antonio; Charles F. Allen, Boerne, both of Tex.

[73] Assignee: S & N Manufacturing, Inc., San Antonio, Tex.

[21] Appl. No.: 405,692

[22] Filed: Aug. 5, 1982

Related U.S. Application Data

[63] Continuation-in-part of Ser. No. 172,838, Jul. 28, 1980, abandoned.

[51] Int. Cl.[4] ..... A63B 61/00

[52] U.S. Cl. ..... 273/29 A; 52/585; 273/395

[58] Field of Search ..... 273/29 A, 185 R, 395, 273/30, 26 A, DIG. 8, 6, 276, 177, 181 R, 181 D, 181 K, 183 R; D25/73; 428/73, 116, 117, 118; 160/113, 115, 119, 222, 229 R; 49/93, 421, 464, 427, 370, 426, 404; 52/585, 578, 579

[56] References Cited

U.S. PATENT DOCUMENTS

| | | | |
|---|---|---|---|
| 419,925 | 1/1890 | Caulfield | 49/427 |
| 1,162,231 | 11/1915 | Fritz | 160/118 |
| 1,307,877 | 6/1919 | Paul | 49/426 |
| 1,843,430 | 2/1932 | Meyer | 52/582 |
| 2,664,596 | 1/1954 | Greg | 428/73 |
| 3,323,797 | 6/1967 | Horton, Jr. | 273/6 |
| 3,348,337 | 10/1967 | Grasso | 49/426 |
| 3,811,489 | 5/1974 | Thun et al. | 160/118 |
| 3,849,758 | 9/1974 | Plumley et al. | 428/73 |
| 4,067,165 | 1/1978 | Timmons | 52/585 |
| 4,290,246 | 9/1981 | Hilsey | 52/582 |
| 4,309,032 | 1/1982 | Facius | 273/29 A |
| 4,373,720 | 2/1983 | Lambard et al. | 273/29 A |

FOREIGN PATENT DOCUMENTS

| | | | |
|---|---|---|---|
| 2542984 | 3/1977 | Fed. Rep. of Germany | 273/29 A |
| 2606071 | 8/1977 | Fed. Rep. of Germany | 273/29 A |
| 536125 | 5/1941 | United Kingdom | 49/426 |

*Primary Examiner*—Richard C. Pinkham
*Assistant Examiner*—T. Brown
*Attorney, Agent, or Firm*—Cox & Smith Inc.

[57] ABSTRACT

A recreational ball rebound wall having a plurality of rigid, portable panels. The panels are supported in a vertical position by a pair of spaced apart support tracks. The panels are supported on the tracks by rollers whereby the panels are horizontally slidable in an abutting relationship. Alignment studs in the abutting edges of each of the panels and rods extending horizontally through the panels are provided for securing the panels in abutting relationship. Wedges are selectively inserted between at least one of the panels and the tracks to position the panels to form a flat, planar surface when the panels are in abutting relationship.

8 Claims, 7 Drawing Figures

BALL REBOUND APPARATUS

CROSS REFERENCE TO RELATED APPLICATIONS

This application is a continuation-in-part of application Ser. No. 172,838, filed July 28, 1980, (abandoned) entitled BALL REBOUND APPARATUS, James R. Stewart and Charles F. Allen, inventors.

BACKGROUND OF THE INVENTION

This invention relates generally to a recreational apparatus and more particularly to a backstop and ball return apparatus for tennis, hand ball and the like.

Attaining proficiency in sports such as tennis requires development of skills, primarily through practice. However, practicing tennis generally requires two people unless a solid stationary wall is present for rebounding the tennis ball. It has been known in the past to build such rebound walls which were often constructed of concrete or wood for rebounding of tennis balls. Such devices serve their purpose but generally involve large construction costs, result in a permanent structure which cannot be relocated or deteriorate when exposed to the elements.

Another example of a rebound wall is found in U.S. Pat. No. 3,697,068 issued to McDougall on Oct. 10, 1972. This patent discloses a rebound wall having a plurality of projecting formation thereon to randomly deflect balls. The wall is formed from outer fiberglass skins enveloping an inner polyurethane core. Reinforcing is provided in the core as needed to provide sufficient rigidity. Other recreational devices are found in U.S. Pat. Nos. 3,918,711 (Zak); 3,989,246 (Brown, et al.); 3,968,967 (Nally); 4,070,018 (Hodges); 4,082,271 (Martin); 4,116,437 (Johnson); and German Pat. No. 2,542,984; and 2,606,071. Examples of honeycomb panels are shown in U.S. Pat. Nos. 2,664,596 (Greig); 2,849,758 (Plumley, et al.); and 3,323,797 (Horton). An example of a panel mounting apparatus is shown in U.S. Pat. No. 3,811,849 (Thun, et al.).

In lieu of a permanent installation such as a concrete wall, it is desirable to provide a wall which can easily be constructed, is relatively inexpensive and is maintenance-free. As is apparent, this requires a device which is light weight so that it can be easily transported and installed. Since the device is exposed to the elements it must be able to withstand rain, wind and sun and still maintain an aesthetically pleasing appearance without regular or expensive maintenance. Also, the materials and construction techniques must be such that the device is affordable by not only large organizations such as schools and clubs but also, to the average home owner.

In the case of tennis and other sports, it is desirable that a rebound wall have certain rebound characteristics to stimulate actual play. This may be achieved in several ways. However, as a practical matter there are limitations which require in addition to having good rebound characteristics, the attributes of low noise, light weight, low maintenance and reasonable cost. One known method of providing strength with low weight is the use of a honeycomb-type structure. An example of this is shown in U.S. Pat. No. 3,104,194 (Zahorski).

Honeycomb has been found to be superior to such inner materials as polyurethane foam for a rebound wall. The reason for this is the reduction of noise caused by striking the wall with a ball.

As far as known, there has not been commercially available recreational rebound wall prior to this invention. This has been achieved by the instant invention by providing a rebound wall which has good rebound characteristics, low maintenance, light weight and which is affordable. It is therefore a primary object of this invention to provide a rebound wall which overcomes the problems that have heretofor prevented or inhibited the commercialization of such a device.

Other objects of the invention will become apparent from the following detailed disclosure.

SUMMARY OF THE INVENTION

A recreational ball rebound wall apparatus formed from a plurality of rigid portable panels which are connected together in abutting relationship to form a planar rebound wall. Means is provided for supporting the plurality of panels in a generally vertical plane which includes a track and rollers so that the plurality of panels can be rolled into abutting relationship for securing with each other. Each panel includes a honeycomb interior and a fiberglass exterior to perform a strong light-weight panel which is resistant to weather, has good rebound characteristics and is not noisy.

DESCRIPTION OF THE PREFERRED EMBODIMENT

Figure 1:
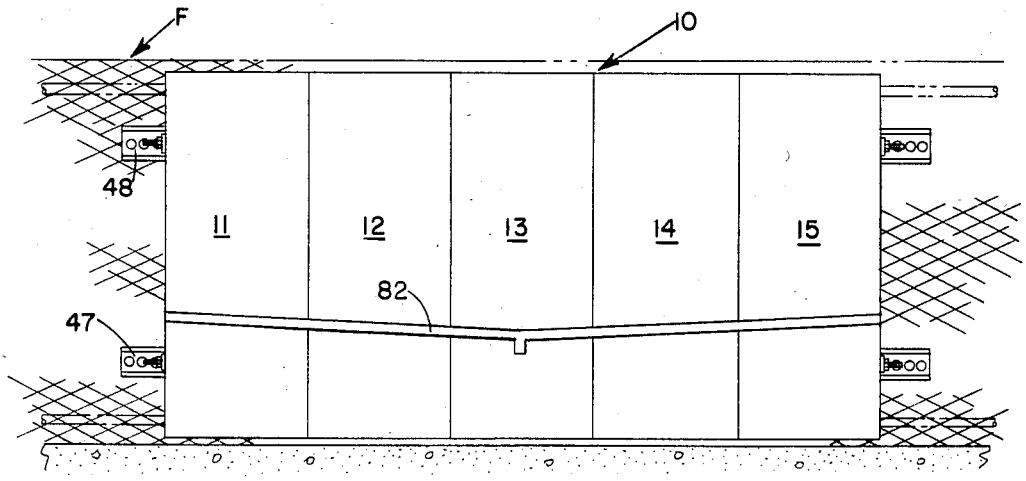
FIG. 1 is an elevation view of the recreational ball rebound wall apparatus of the invention installed against a support structure such as a chain link fence.

Referring to FIG. 1 of the drawings, there is shown a recreational ball rebound wall apparatus of the invention. Ball rebound device 10 is shown mounted upon a chain-link fence S of the type which typically surrounds tennis courts. It is understood that the ball rebound device of the invention could also be mounted on other structures.

The ball rebound device 10 includes five (5) identical panels, 11, 12, 13, 14 and 15 which are secured together to form a planar rebound wall. The individual panels help facilitate construction, transport and erecting. In the case of tennis rebound walls, it is preferable that the wall generally have an overall width of about twenty (20) feet and a height of about ten (10) feet. The width can be varied by adding or removing panels to the wall.

Figure 2:
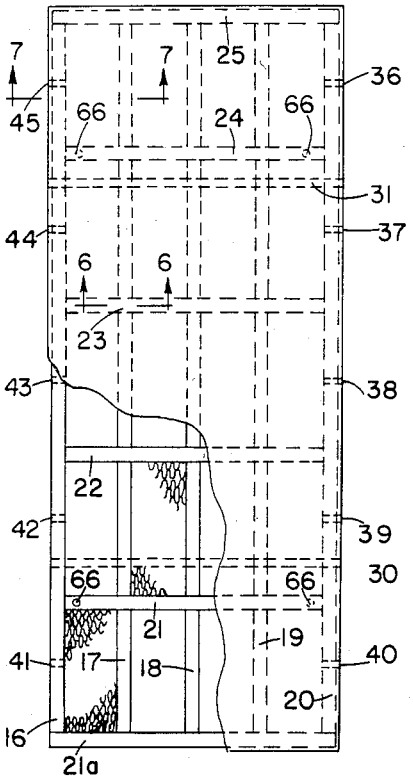
FIG. 2 is a partially broken view of one of the panels shown in FIG. 1 which illustrates the interior structure of the panel.
Figure 6:
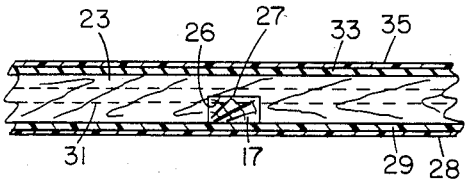
FIG. 6 is a cross-sectional view taken along line 6—6 in FIG. 2 showing the interlocking notches of the reinforcing members.
Figure 7:
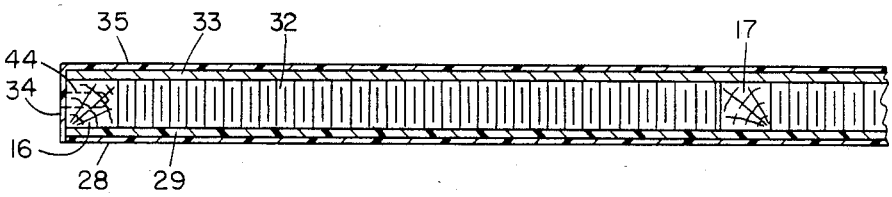
FIG. 7 is a schematic cross-sectional view taken along line 7—7 in FIG. 2 showing the construction of the panel.

The construction of each panel is best shown in FIGS. 2, 6 and 7. Each panel includes a plurality of vertical metal or wood studs struts 16, 17, 18, 19 and 20 which are interconnected with a plurality of horizontal wood struts 21, 22, 23, 24 and 25. As best shown in FIG. 6, the wood struts include mating notches, such as notch 26 in strut 23 and notch 27 in strut 17. This interlocking of the wood struts is to add strength to the skeleton frame work. The struts are also secured with each other by suitable means such as glue, nails, staples or fiberglass.

The cross-section of the panel, as best shown in FIG. 7, is best understood by its method of manufacture. In manufacturing the device, a generally rectangular recessed form is used. After applying a releasing agent to the form a first step in manufacturing is to apply a layer of fiberglass and resin to the bottom and sides of the form which is schematically represented by layer 28 in FIG. 7. After the resin has gelled an additional layer 29 of fiberglass and resin is applied. The vertical and horizontal struts are then positioned on top of the layer 29, spaced from the walls of the form. As best shown in FIG. 2., cylindrical tubing sections 30 and 31 which are preferably plastic pipe extend through apertures in the struts across the panel for purposes explained more fully hereinafter. In the open portions between the struts, honeycomb material such as honeycomb section 32 which is preferably in the form of treated cardboard or the like is positioned. The purpose of the honeycomb material is to provide strength while minimizing the weight of each panel. Also, the honeycomb material is important to the low noise and rebound characteristics of the device. A cardboard or plywood sheet is applied to the top of the struts and secured thereto by laminated layers of fiberglass and when secured provides rigidity to the device but does add greatly to the weight. An outer layer of fiberglass is completed by adding resin and fiberglass to form an envelope encasing the inner materials. The outer covering of fiberglass forms a weather resistant cover for each rigid panel which forms the rebound wall of the invention. Each panel also includes a plurality of apertures, 36, 37, 38, 39, 40, 41, 42, 43, 44 and 45 which are positioned in the vertical struts 16 and 20 respectively for purposes of installation as is explained more fully hereinafter.

The entire panel is covered with a layer of solid green "gel coat" to provide a long lasting durable exterior protective coating.

Figure 3:
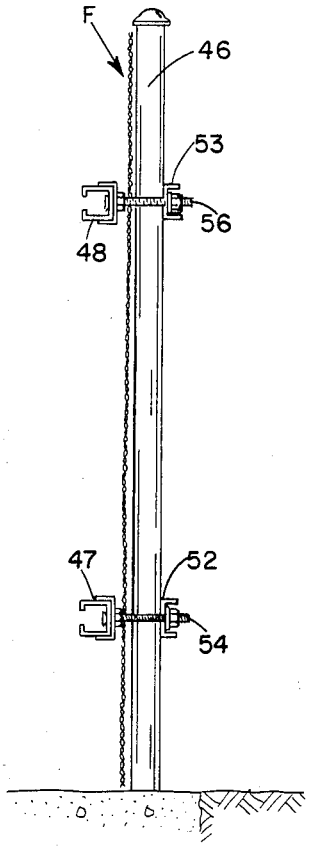
FIG. 3 is a cross-sectional view of the channels in position, attached to posts for installation of the panels.
Figure 4:
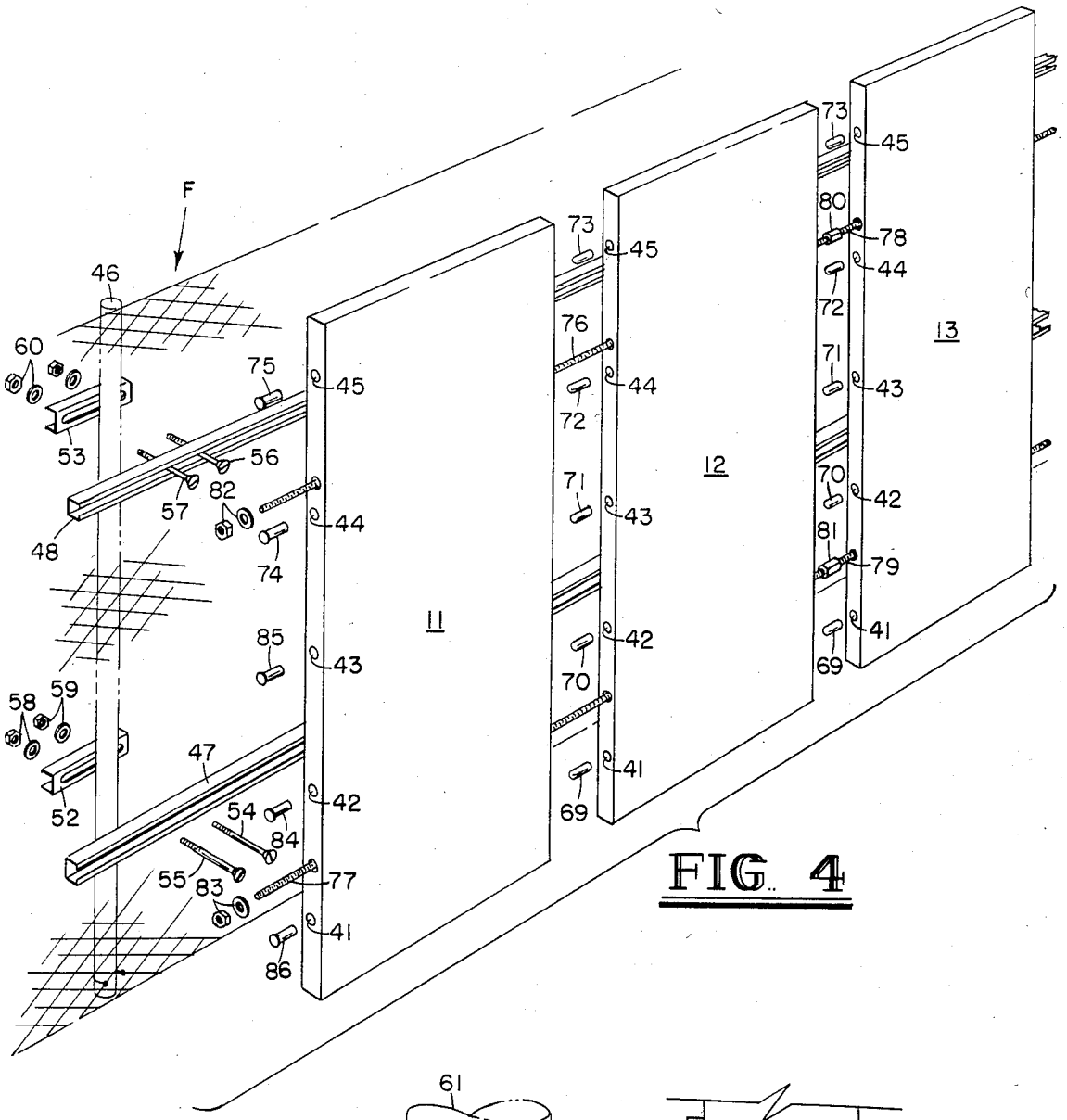
FIG. 4 is an exploded view showing the components which make up the rebound wall apparatus.
Figure 5:
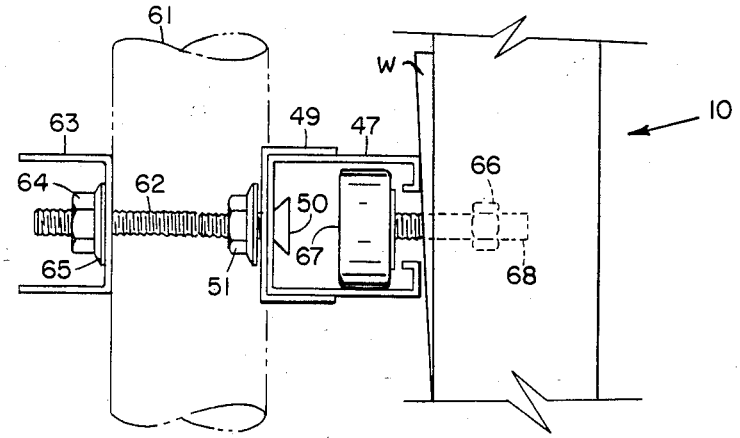
FIG. 5 is a partial cross-sectional view showing the channel attached to a support post with a roller positioned in the channel and secured to one of the panels.

The mounting system for the panels is best shown in FIGS. 3, 4 and 5. A typical installation for the device is on a chain-link fence of the type used for tennis courts. In this connection, it is necessary that the posts such as post 46 be of steel construction so that it will withstand the weight of the panels and will also withstand most winds directed at the panels.

A plurality of channels 47 and 48 are secured to posts 46 and to additional posts as necessary (not shown) to provide supports for the panels. The channels, such as channel 47 as shown in FIG. 5 may consist of one or more sections which is joined by a coupler 49. Each coupler 49 secures sections of the channel 47 together by suitable means such as a bolt 50 and nut 51. Each channel member 47 and 48 is secured to the post 46 by suitable means such as brackets 52 and 53 by bolts 54, 55, 56 and 57 and nuts and washers 58, 59 and 60 and an additional nut and washer (not shown) for bolt 56. Channel member 47 is shown attached to a post 61 by a bolt 62, bracket member 63, nut 64 and washer 65 in FIG. 5.

As best shown in FIG. 5, a nut 66 is positioned in an aperture in cross struts such as struts 21 and 24 and is secured in position with resin. The nut 66 receives wheel assembly 67 which includes a threaded axle 68 which is screwed into the nut 66 to adjust the position of the wheel assembly 67 relative to the panel. As will be apparent, the wheel assembly 67 is designed to be rollably received within the channels 47 and 48 and four (4) wheel assemblies are generally provided for each panel with two (2) laterally spaced wheel assemblies at the top and two (2) laterally spaced wheel assemblies at the bottom.

In practice, the channels 47 and 48 are secured to the support structure such as posts which support the fence F such as post 46. The wheel assemblies are inserted in the panels and each panel is then rolled into position at the end of the channels. In practice the panels are positioned in close proximity to the ground surface such that they can be rolled in position by slightly lifting the panels. In this connection sufficient channel may be provided so that the panels may be moved from one adjacent tennis court to another without dismantling the apparatus since they may be rolled upon the rollers to a desired location.

To secure the panels together to form the rebound wall 10 as shown in FIG. 1, there are provided the apertures 36, 37, 38, 39, 40, 41, 42, 43, 44 and 45 and the pipes 30 and 31. As best shown in FIG. 4, cylindrical plugs 69, 70, 71, 72 and 73 are provided for insertion in the apertures to secure the panels together. In this connection the plugs provide a close friction fit in the apertures. The panels which form the end of the wall include plastic plugs or pins 74, 75, 84, 85 and 86 which block the holes to prevent moisture from getting into the panels through the apertures 41, 42, 43, 44 and 45.

The panels are held together in tight arrangement by threaded rods 76, 77 and 79 which extend through the tubing 30 and 31 which is located in each panel. In this connection rod couplers 80 and 81 may be utilized to allow the threaded rods to be shipped in sections. The panels are positioned in abutting relationship as shown in FIG. 1 and with the threaded rods inserted in the pipes 30 and 31, nut and washer assemblies 82 and 83 are utilized to tightly draw the panels together and form a planar wall. In order to position the panel members flush with each other, wedges such as wedge W may be driven between the channel 47 and panel as shown in FIG. 5. This forms a flat wall from the panels to provide proper rebound.

As best shown in FIG. 1, tape 82 which may be formed of polyethylene tape or painted white line, may be positioned to simulate the location of a net. This can also be done with paint if desired.

Although the invention has been described in conjunction with the foregoing specific embodiment, many alternatives, variations and modifications will be apparent to those of ordinary skill in the art. Those alternatives, variations and modifications are intended to fall within the spirit and scope of the appended claims.

We claim:

1. A recreational ball rebound wall apparatus comprising:

a plurality of rigid, portable panels having upper and lower edges and a weather resistant exterior for securing in abutting relationship to form a vertical, planar rebound wall;

means for securing the panels in abutting relationship to a support means including a plurality of vertically spaced, horizontal tracks and sliding means operatively engaging the tracks spaced intermediate said upper and lower edges so the plurality of panels can be slid along the tracks into abutting relationship to facilitate installation of the plurality of panels; and wedges for selective insertion in between at least one of the panels and the horizontal track to position the panels to form a flat, planar surface when the panels are in abutting relationship.

2. The apparatus as set forth in claim 12, wherein:

the sliding means includes rollers which mate with the track to allow the panels to be rolled along the track.

3. The apparatus as set forth in claim 1, wherein:

the rebound wall apparatus includes rods extending horizontally through apertures in the panels and means releasably engaging the rods for securing the panels in abutting relationship.

4. The apparatus as set forth in claim 1, wherein:

the rebound wall apparatus includes alignment pins slidably engaging mating apertures in each abutting panel to secure the panels together.

5. The apparatus as set forth in claim 1, wherein the apparatus includes:

each panel including a honeycomb interior and a fiberglass exterior envelope to form a strong, light-weight panel and provide said resistance to weather, and has good rebound characteristics low noise when struck by a ball.

6. The apparatus as set forth in claim 5, wherein:

each panel includes a plurality of interconnected struts.

7. The apparatus as set forth in claim 6, wherein:

the rebound wall apparatus includes means for securing the panels in abutting relationship to form a vertical planar rebound wall.

8. The apparatus as set forth in claim 5, wherein:

each panel includes a rigid sheet positioned interior to the fiberglass envelope to provide rigidity and strength to each panel.

* * * * *